United States Patent [19]

Baillemont et al.

[11] Patent Number: 5,024,552

[45] Date of Patent: Jun. 18, 1991

[54] METHOD OF OBTAINING A COMPOSITE SEALING STRUCTURE FOR PERMANENT ROADWAYS

[75] Inventors: Ghislaine Baillemont, Eaubonne; Jean Beauverd, Lausanne/Suisse, both of France

[73] Assignee: Colas S.A., Paris, France

[21] Appl. No.: 482,951

[22] Filed: Feb. 22, 1990

[30] Foreign Application Priority Data

Feb. 23, 1989 [FR] France ..... 89 02366

[51] Int. Cl.[5] ..... E01C 3/00

[52] U.S. Cl. ..... 404/31; 404/44

[58] Field of Search ..... 404/31, 44, 27

[56] References Cited

U.S. PATENT DOCUMENTS

| | | | |
|---|---|---|---|
| 3,545,348 | 12/1970 | Anderson | 404/44 X |
| 3,690,227 | 9/1972 | Welty | 94/33 |
| 4,174,912 | 11/1979 | Peterson | 404/31 X |
| 4,523,755 | 6/1985 | Turba | 404/31 X |
| 4,634,084 | 1/1987 | Magnusson | 404/31 X |
| 4,653,956 | 3/1987 | Lang | 404/31 X |
| 4,830,532 | 5/1989 | Macke et al. | 404/31 |
| 4,850,738 | 7/1989 | Niemi | 404/31 |
| 4,909,662 | 3/1990 | Baker | 404/31 |

FOREIGN PATENT DOCUMENTS

| | | |
|---|---|---|
| 178345 | 10/1984 | European Pat. Off. . |
| 1658603 | 10/1970 | Fed. Rep. of Germany . |
| 2439573 | 2/1976 | Fed. Rep. of Germany . |

*Primary Examiner*—Ramon S. Britts
*Assistant Examiner*—Gay Ann Spahn
*Attorney, Agent, or Firm*—Sandler, Greenblum, & Bernstein

[57] ABSTRACT

A method of obtaining a composite sealing structure for permanent roadways, in which there is applied, between the at least partially concrete base support and the sealed layer or layers, a draining mix having a high content of voids which enable the air and/or the water being released in the form of vapor from the support to be diffused in order to prevent the appearance of deformities, including bubbles and blisters.

20 Claims, 1 Drawing Sheet

METHOD OF OBTAINING A COMPOSITE SEALING STRUCTURE FOR PERMANENT ROADWAYS

BACKGROUND OF THE INVENTION

1. Field of the Invention

The present invention relates to a method of obtaining a composite sealing structure for permanent roadways works and to the corresponding structure.

The sealing of the roadways of permanent works is a special field which employs specific techniques.

It is expedient, in fact, to protect the permanent work against the arrival of water laden with noxious agents. The sealing helps to ensure the correct behavior of the supporting framework; namely by indirectly supports the traffic and its effects The support, which usually consisting mainly of a concrete roadway, includes pores in the form of residual voids and fissures which store more or less humid air and/or water. This air or this water is released in the form of vapor during the application of the sealing products at temperatures which are always above the ambient temperature, and capable of reaching 250° C. in the case of asphalt. In addition, this water vapor is released during the operating period of the work.

Such release of air or water may produce bubbles, blisters or swellings which might well damage the sealing upon its application, and subsequently, over time, the course of the entire structure including the surface and support.

Up until the present invention, products used for dissipating this air and/or water are, for example, kraft paper or glass web material. These products cannot be applied automatically and to date it has been necessary to lay them manually.

In addition, there is a problem during the application of a bituminous material onto such products; namely, as the finisher passes over, there is the risk of displacing the kraft paper or the glass grating.

In certain techniques of the prior art, the sealing of poured asphalt includes two-grades, the first layer of asphalt mastic being topped by a second sealing and protective layer of gritted poured asphalt.

The sealing based on synthesis materials is ensured by a thin film based on synthetic resin poured into place and adhering to the support.

The sealing with prefabricated sheets is unilayer or two-grade.

All these types of sealing according to the prior art are always placed underneath the road carpet and they constitute the actual sealing of the permanent works.

Besides the problem mentioned above concerning the porosity and the diffusion of the water vapor, one of the major constraints in the production of a sealing for permanent works lies in its turnaround time. The implementation of the sealing is carried out during the final phase of the works and it is often essential to complete it as quickly as possible so as to be able to keep to the delivery dates for the work.

In the prior art, various methods known as Sealing by High-Speed Means or HSM sealing are employed, using mechanical road construction equipment.

SUMMARY OF THE INVENTION

The present invention proposes a method of obtaining a composite sealing structure for roadways of permanent works and the structure obtained which overcome the previous disadvantages.

The present invention proposes a method of obtaining a composite sealing structure for roadways of permanent works, in which there is applied, between the at least partially concrete base support and the sealed layer or layers, a draining mix having high content of voids which enable the air and/or the water being released from the support to be diffused in order to prevent the appearance of deformities including bubbles, blisters or the like.

A further object of the invention is a composite sealing structure for roadways of permanent works, including a draining mix (4) between the at least partially concrete base support (2) and the sealed layer or layers (5).

Another object of the invention is a composite sealing structure for roadways of permanent works, comprising, starting from an at least partially concrete base support:

a) at least one impregnating varnish, b) at least one sealed layer, c) at least one binding layer, d) at least one road carpet, which is characterized in that it includes, in addition, a draining mix applied between the base support and the sealed layer or layers.

The present invention also relates to the characteristics below considered in isolation or in all their technically possible combinations:

the draining mix is applied manually or using mechanical equipment such as a finisher;

the draining mix is applied onto the base support after the latter has been overlaid with an impregnating varnish;

a binding layer is spread between the impregnating varnish and the draining mix;

one or more leveling layers is or are applied underneath or on top of the draining mix;

the draining mix is a bituminous mix having approximately 15 to approximately 25% of voids;

the impregnating varnish is mainly intended to keep the concrete free from water and remains permeable to vapor.

BRIEF DESCRIPTION OF THE DRAWING

Various advantages and characteristics of the present invention will emerge from the detailed description below, given with reference to the accompanying drawing, in which.

DETAILED DESCRIPTION OF THE PREFERRED EMBODIMENTS

Figure 1:
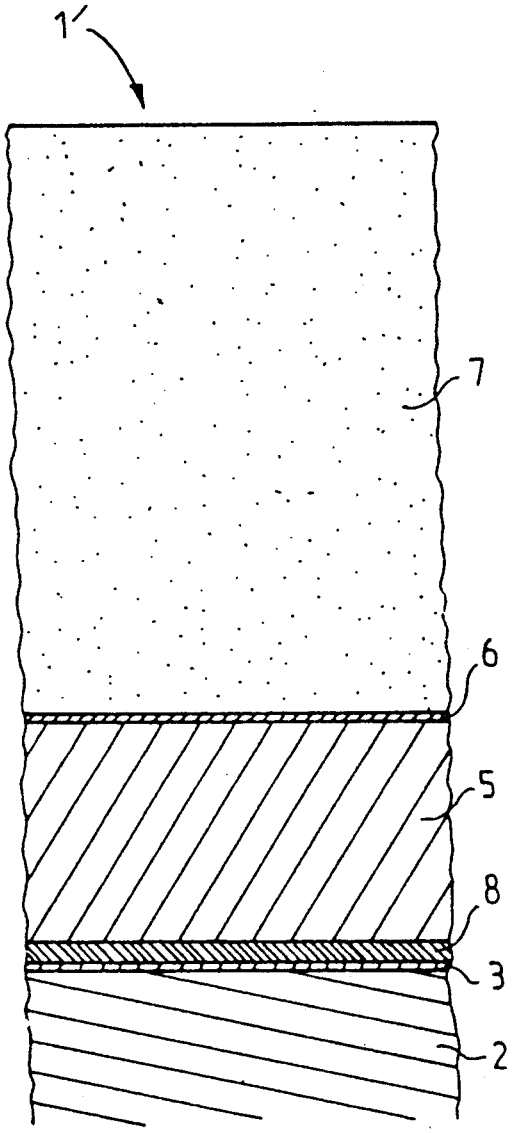
FIG.1 PRIOR ART
FIG. 1 illustrates a composite sealing structure according to the prior art.

In the accompanying drawing, 1 and 1' denote composite sealing structures. According to the prior art the composite sealing structure 1' is composed of an impregnating varnish 3 applied onto a base support 2 which is at least partially of concrete, but it is also possible to have a metal flooring or another support made up with bitumen. A glass cloth 8 is laid on the binding or impregnating varnish 3. The glass cloth 8 is covered with one (or more) sealed layer(s) 5, which is coated with a binding layer 6, onto which is applied a road carpet 7 possibly preceded by an intermediate leveling layer. Such a composite sealing structure 1' has a number of disadvantages with respect to its production and its implementation. The first problem is that of the application of the glass cloth 8, this application generally being manual and necessitating various manipulations to enable a finisher to pass over.

Figure 2:
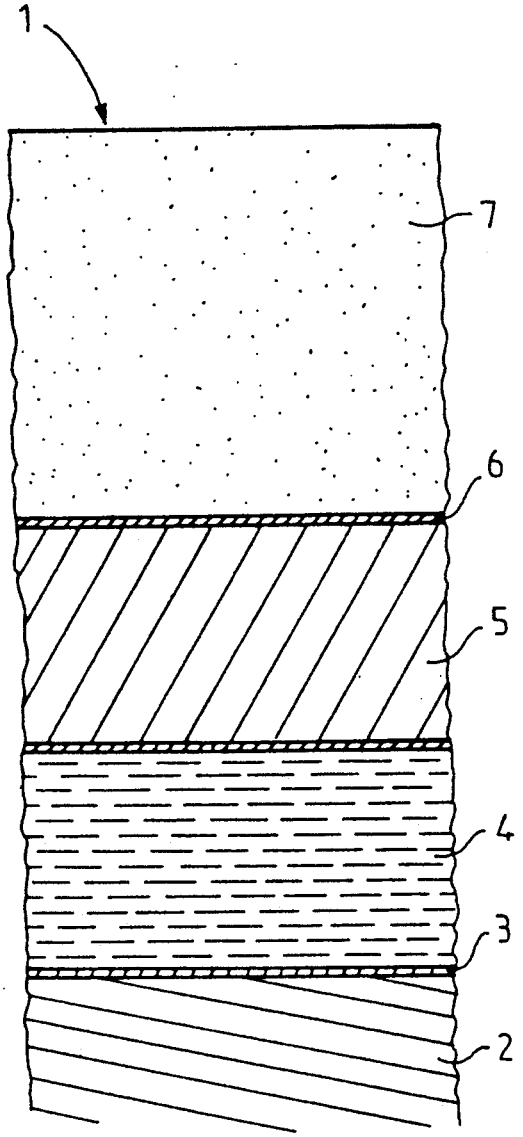
FIG. 2 represents a composite sealing structure according to the present invention.

The composite sealing structure for roadways of permanent works of the invention is illustrated in FIG. 2. In this FIG., 2 likewise denotes an at least partially concrete base support. An impregnating varnish 3 is likewise applied onto this base support 2. According to the invention, a draining mix 4, also called open drain or porous mix, is applied onto the concrete support 2 after overlaying the impregnating varnish 3. This draining mix 4 is a bituminous mix which, instead of having 5 to 7% of voids as in the dense mixtures, includes approximately 15 to 25% of voids. This high content of voids enables the more or less humid air which is released from the base support 2 to be no longer pressurized but to dissipate in the draining mix 4. A sealed layer 5 is applied onto the draining mix 4. The binding layer 6 is applied on top of the sealed layer 5. The surface 7, consisting of a road carpet and an optional intermediate leveling layer, is applied onto the binding layer 6.

In certain cases, it is necessary to apply one or more leveling layers on top of or underneath the draining mix 4.

The invention is not limited to the embodiments shown and described in detail, and various modifications may be made to it without departing from its scope.

We claim:

1. A method of obtaining a composite sealing structure for permanent comprising applying a draining mix layer between an at least partially concrete base support layer and at least one sealed layer, said draining mix layer having a high content of voids which enable air and/or water being released as vapor from the at least partially concrete base support layer to be diffused, so as to prevent appearance of deformities including bubbles and blisters in said at least one sealed layer.

2. The method according to claim 1, wherein said draining mix layer is manually applied.

3. The method according to claim 1, wherein said draining mix layer is applied with mechanical equipment.

4. The method according to claim 1, wherein an impregnating varnish is applied onto said at least partially concrete base support layer prior to said draining mix layer, and is positioned therebetween.

5. The method according to claim 1, further including applying at least one binding layer.

6. The method according to claim 4, further including applying at least one binding layer.

7. The method according to claim 1, further including applying at least one leveling layer.

8. The method according to claim 4, further including applying at least one leveling layer.

9. The method according to claim 6, further including applying at least one leveling layer.

10. The method according to claim 1, wherein said draining mix layer comprises a bituminous mix having about 15 to 25% voids.

11. The method according to claim 6, wherein said draining mix layer comprises a bituminous mix having about 15 to 25% voids.

12. Composite sealing structure for permanent roadways comprising:

an at least partially concrete base support layer;

at least one sealed layer;

and a draining mix layer positioned between said at least partially concrete base support layer and said at least one sealed layer, said draining mix layer having a high content of voids which enable air and/or water being released as vapor from said at least partially concrete base support layer to be diffused, so as to prevent appearance of deformities including bubbles and blisters in said at least one sealed layer.

13. The composite sealing structure according to claim 12, further including an impregnating varnish layer between said at least partially concrete base support layer and said draining mix layer.

14. The composite sealing structure according to claim 13, further including at least one binding layer.

15. The composite sealing structure according to claim 12, further including at least one road carpet positioned above said at least one sealed layer.

16. The composite sealing structure according to claim 14, further including at least one road carpet positioned above said at least one sealed layer, and said at least one binding layer includes a binding layer positioned between said at least one sealed layer and said at least one road carpet.

17. The composite sealing structure according to claim 12, further comprising at least one leveling layer.

18. The composite sealing structure according to claim 13, wherein said draining mix layer comprises a bituminous mix having about 15 to 25% voids.

19. The composite sealing structure according to claim 13, wherein said impregnating varnish layer is constructed to maintain said at least partially concrete base support layer free from water, and is permeable to water vapor.

20. The composite sealing structure according to claim 12, wherein said at least one sealed layer comprises poured asphalt, or at least one sheet of bitumen rich in elastomer or a bituminous mortar.

* * * * *

UNITED STATES PATENT AND TRADEMARK OFFICE

CERTIFICATE OF CORRECTION

PATENT NO. : 5,024,552
DATED : June 18, 1991
INVENTOR(S) : Ghislaine BAILLEMONT et al.

It is certified that error appears in the above-indentified patent and that said Letters Patent is hereby corrected as shown below: On the title page:

Item [75] Inventors: after "Eaubonne" insert ---, France---.
Item [75] Inventors: delete "both of France".
At column 1, line 10, after "to" delete "the".
At column 1, line 17, after "effects" insert ---.---.
At column 1, line 21, after "This air or" delete "this".
At column 1, line 29, after "over" insert ---the course of---.
At column 1, line 30, delete "of course of---.
At column 2, line 32, after "equipment" insert ---,---.
At column 2, line 38, after "is" delete "or are".

Signed and Sealed this

Fourth Day of April, 1995

Bruce Lehman

*Attest:*

BRUCE LEHMAN

*Attesting Officer*

*Commissioner of Patents and Trademarks*